US005967655A

United States Patent [19]

Hills

[11] Patent Number: 5,967,655

[45] Date of Patent: Oct. 19, 1999

[54] SYSTEM FOR MIXING CEMENTING MATERIAL AND MINERAL AGGREGATE

[76] Inventor: A. Wayne Hills, 181 Tremaine, Chandler, Ariz. 85224

[21] Appl. No.: 08/635,979

[22] Filed: Apr. 22, 1996

[51] Int. Cl.[6] ..... B28C 7/10

[52] U.S. Cl. ..... 366/20; 366/21; 366/35; 366/156.2

[58] Field of Search ..... 366/8, 20, 21, 366/26, 33, 35, 38, 50, 156.1, 156.2, 158.2, 158.3, 192, 193, 606

[56] References Cited

U.S. PATENT DOCUMENTS

| | | | |
|---|---|---|---|
| 475,618 | 5/1892 | Skinner | 366/35 X |
| 876,270 | 1/1908 | Fulton | 366/21 |
| 1,226,108 | 5/1917 | Olney | 366/20 X |
| 1,593,517 | 7/1926 | Tharrington | 366/158.3 X |
| 2,017,439 | 10/1935 | Grayson | 366/35 X |
| 2,031,326 | 2/1936 | Miller | 366/20 |
| 2,608,395 | 8/1952 | August | 366/38 |
| 2,638,252 | 5/1953 | Zahn | 366/158.3 X |
| 2,709,075 | 5/1955 | August | 366/38 |
| 3,048,377 | 8/1962 | Braitsch | 366/38 X |
| 3,885,774 | 5/1975 | Harris et al. | 366/20 |
| 4,071,226 | 1/1978 | Miller | 366/35 X |
| 4,219,279 | 8/1980 | Haws | 366/35 |
| 4,855,960 | 8/1989 | Janssen et al. | 366/8 |
| 4,956,821 | 9/1990 | Fenelon | 366/8 |
| 5,149,192 | 9/1992 | Hamm et al. | 366/8 |
| 5,433,520 | 7/1995 | Adams et al. | 366/8 |

FOREIGN PATENT DOCUMENTS

| | | | |
|---|---|---|---|
| 512842 | 10/1920 | France | 366/20 |
| 675222 | 10/1929 | France | 366/35 |

*Primary Examiner*—Charles E. Cooley
*Attorney, Agent, or Firm*—Tod R. Nissle, P.C.

[57] ABSTRACT

Apparatus for mixing cementing material and mineral aggregate includes a container having a first chamber and a second chamber each having a top and a bottom. Cementing material is in the first chamber. Mineral aggregate is in the second chamber. An auger is attached to the bottom of the first and second chambers to receive and dispense cementing material from the first chamber and mineral aggregate from the second chamber. The mineral aggregate is dispensed at a rate different from that of the cementing material. The container includes extendable legs and is carried on a lift at the rear of a vehicle. The lift is raised to permit the container legs to be extended. After the legs are extended, the lift is lowered and the vehicle is driven away, leaving the container free-standing on its legs.

1 Claim, 4 Drawing Sheets

SYSTEM FOR MIXING CEMENTING MATERIAL AND MINERAL AGGREGATE

BACKGROUND OF THE INVENTION

1. Field of the Invention

This invention relates to a system for transporting, dispensing, and mixing cementing material and mineral aggregate.

More particularly, the invention relates to apparatus which can simultaneously dispense cementing material and mineral aggregate at varying rates and which can mix the cementing material and mineral aggregate in varying proportions.

In another respect, the invention pertains to a system for transporting unmixed cementing material and mineral aggregate to a remote site.

2. Description of the Related Art Including Information Disclosed Under 37 C.F.R. Sections 1.97 and 1.00

Containers for dispensing totally mixed, ready-to-use mortar products and other cementing materials at a construction site are well known. For example, U.S. Pat. No. 4,956,821 to Fenelon discloses a silo from which a dry premixed mortar blend is dispensed. The silo described in the Fenelon patent has disadvantages. First, the Fenelon silo is made to be transported by a fork lift. Driving or transporting a fork lift to a construction site simply to erect the Fenelon silo often is undesirable because it increases personnel and other overhead costs. Second, once the Fenelon silo is on site, a forklift or crane is be utilized to charge the silo with 3000 pound bags of premixed mortar blend. This means that both the 3000 bags and the fork lift or crane must be transported to the construction site to charge the silo, again incurring additional labor and other overhead costs. Third, the Fenelon silo requires dry premixed mortar blend. Bags of premixed mortar are substantially more expensive than the bulk cement and sand utilized in preparing the dry mortar blend.

Accordingly, it would be highly desirable to provide a system which would deliver and dispense mixes of mortar and other cementing material at a construction site without requiring that a forklift, crane, and additional personnel be dedicated to assembling and filling a dispensing container. It also would be desirable to provide a system which would dispense mixes of mortar and other cementing materials without requiring the use of dry premixed blends of mortar or other cementing materials.

Therefore, it is a principal object of the invention to provide an improved system for dispensing blends of mortar and other cementing materials.

A further object of the invention is to provide apparatus which can, without requiring a crane or forklift to erect the apparatus at a construction site, be utilized to dispense blends of mortar and other cementing materials.

Another object of the invention is to provide apparatus which does not require the use of bags of dry premixed blends of cementing materials in order to dispense such cementing materials at a construction site.

Still a further object of the invention is to provide apparatus which can be utilized at a construction site to dispense different blends of cementing materials and mineral aggregate.

BRIEF DESCRIPTION OF THE DRAWINGS

These and other, further and more specific objects and advantages of the invention will be apparent to those skilled in the art from the following detailed description thereof, taken in conjunction with the drawings, in which.

SUMMARY OF THE INVENTION

Briefly, in accordance with my invention, I provide apparatus for mixing cementing material and mineral aggregate. The apparatus includes a container having a first chamber and a second chamber each having a top and a bottom; cementing material in the first chamber; mineral aggregate in the second chamber; and, an auger attached to the bottom of the first and second chambers to receive and dispense cementing material from the first chamber and mineral aggregate from the second chamber. The mineral aggregate is dispensed at a rate different from that of the cementing material.

In another embodiment of the invention, I provide a system for transporting cementing material and mineral aggregate from a first site to a remote second site and for dispensing the cementing material and mineral aggregate at the second site. The system includes a container having a first chamber and a second chamber each having a top and a bottom; cementing material in the first chamber; mineral aggregate in the second chamber; apparatus attached to the bottom of the first and second chambers to receive and dispense cementing material from said first chamber and mineral aggregate from the second chamber; a plurality of legs connected to the container and each adjustable between a first length and a second length longer than the first length; and, a vehicle having a bed. The bed is shaped to fit beneath the container when the legs are adjusted to the second length; and are displaceable between a first raised operative position to permit each of the legs to be adjusted from the second length to the first length, and a second operative position in which the bed and the container are lowered into a transport position on the vehicle.

In a further embodiment of the invention, I provide apparatus for mixing cementing material and mineral aggregate. The apparatus includes a container having a first compartment and a second compartment each having a top, a bottom, and an opening at the bottom; a cementing material in the first compartment; mineral aggregate in the second compartment; an auger attached to the bottom of the first and second compartments to receive and dispense cementing material from the opening in the first compartment and mineral aggregate from the opening in the second compartment; and, apparatus for varying the size of openings.

DESCRIPTION OF THE PREFERRED EMBODIMENT

Figure 1:
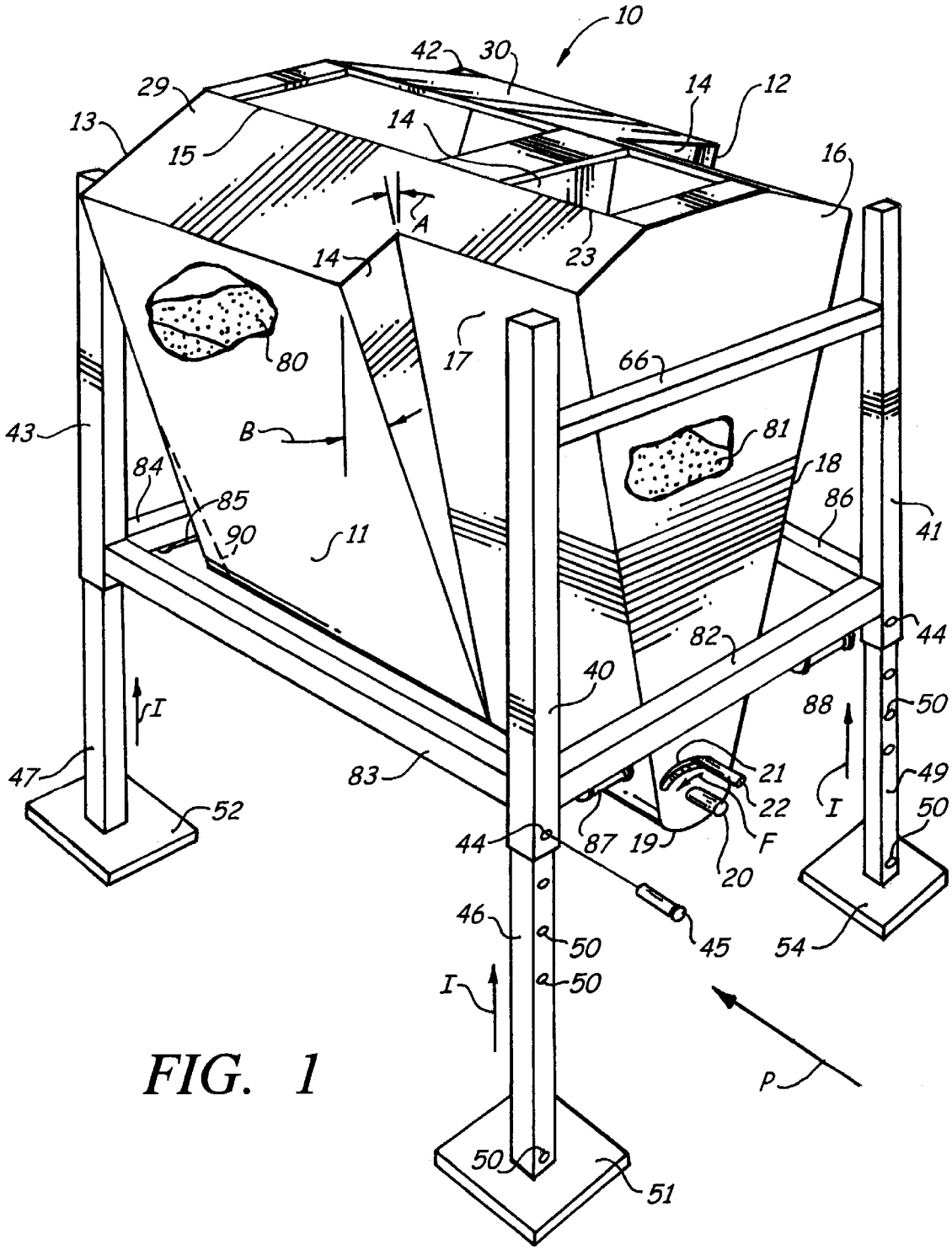
FIG. 1 is a perspective view illustrating dispensing apparatus constructed in accordance with the principles of the invention.

Turning now to the drawings, which depict the presently preferred embodiments of the invention for the purpose of illustrating the practice thereof and not by way of limitation, and in which like reference characters refer to corresponding elements throughout the several views, FIG. 1 illustrates a container or bin 10 for transporting, dispensing, and mixing discrete quantities of cementing material and mineral aggregate. Container 10 includes a first storage chamber or compartment for sand or other mineral aggregate 80 and a second storage chamber or compartment for cement or other cementing material 81. The first storage chamber includes spaced apart, opposed, canted side walls 11 and 12, and also includes parallel side walls 13 and 14. Canted upper walls 29 and 30 bound rectangular opening 15 formed in the top of the first storage chamber for charging the first storage chamber with sand 80. If desired a cover or lid can be provided for opening 15.

The second storage chamber includes spaced apart, opposed, canted side walls 17 and 18 and includes side wall 16 and a portion of side wall 14. Wall 14 is parallel to wall 16. Rectangular opening 23 is formed in the top of the second storage chamber for charging the second chamber with cement 81. A cover can, if desired, be provided for opening 23.

The rectangular frame for supporting the first and second storage chambers includes vertically oriented hollow tubular legs 40 to 43. Each leg 40 to 43 slidably receives a telescoping leg member 46 to 49, respectively. Each leg 40 to 43 includes an aperture 44 formed through its lower end. Each telescoping leg member 46 to 49 includes a plurality of apertures 50 formed therethrough. After a telescoping leg member 46 to 49 has been extended a selected distance out of its associated leg 40, 43, 42, 41, respectively, a pin 45 is inserted through aperture 44 and a selected one of apertures 50 to secure the leg member in its desired position. Each telescoping leg member 46 to 49 is attached to a rectangular pad or foot 51 to 54, respectively. In FIG. 1, each telescoping leg member 46–49 is slidably extended a distance out of its associated leg 40, 43, 42, 41, respectively. Members 46–49 are retracted by removing the pin 45 securing each member 46–49 in its extended position and by sliding each member 46–49 in the direction of arrow I back into its associated leg 40, 43, 42, 41. A pin 45 is inserted through an aperture pair 44–50 to secure each member 46–49 in place. Horizontally oriented elongate tubular frame members 66 and 82 interconnect legs 40 and 41. Elongate horizontally oriented tubular frame members 67 and 84 interconnect legs 42 and 43. Horizontally oriented tubular frame member 83 interconnects legs 40 and 43. Horizontally oriented tubular frame member 86 interconnects legs 41 and 42.

Side wall 16 is fixedly attached to horizontally oriented tubular frame members 66 and 82. Side wall 13 is fixedly attached to horizontally orientated tubular frame members 67 and 84. The lower part of wall 13 can be canted in the manner indicated by dashed line 94. Canted side walls 11, 12, 17, and 18 co-terminate at arcuate bottom 19. Side walls 11 and 12 are canted from the vertical by an amount indicated by arrows B. The angle indicated by arrows B is presently 65 degrees and is preferably in the range of 60 to 70 degrees. Side walls 17 and 18 are canted from the vertical by an amount indicated by arrows A. The angle indicated by arrows A is presently 78 degrees and is preferably in the range of 70 to 85 degrees.

A pair of spaced-apart rollers 87, 88 is attached to the underside of frame member 82. Another spaced-apart pair of rollers 85, 89 (FIG. 2) is attached to the underside of frame member 84.

Figure 2:
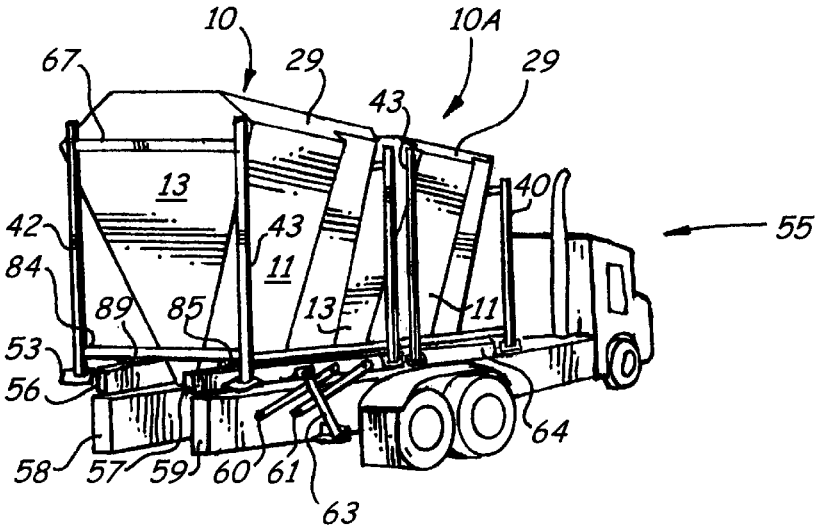
FIG. 2 is a perspective view illustrating the dispensing apparatus of FIG. 1 in conjunction with a vehicle utilized to transport the dispensing apparatus intact to a construction site.
Figure 4:
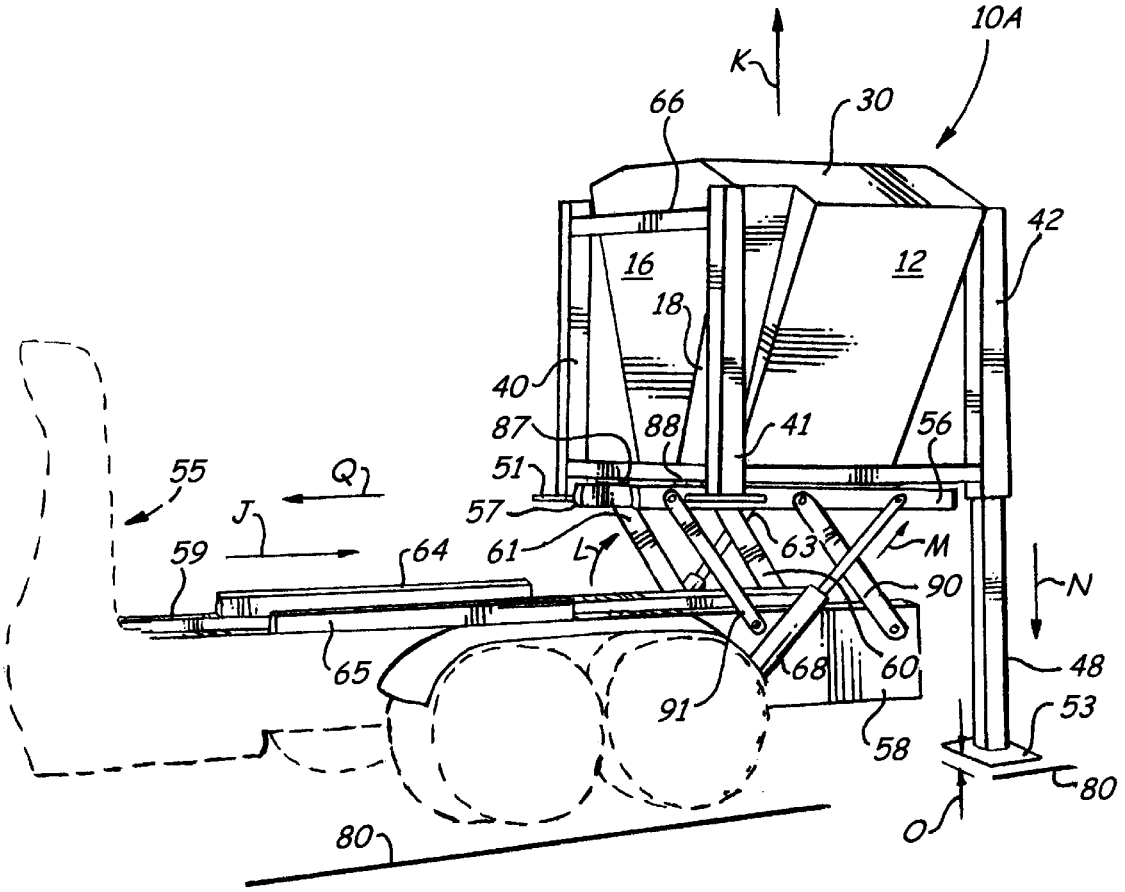
FIG. 4 is a perspective view illustrating the vehicle and dispensing apparatus of FIG. 2 during erection of the dispensing apparatus at a construction site; and, FIG. 5 is a perspective view illustrating the arcuate valve used to meter the flow of cementing material and mineral aggregate from the apparatus of FIG. 1.
Figure 5:
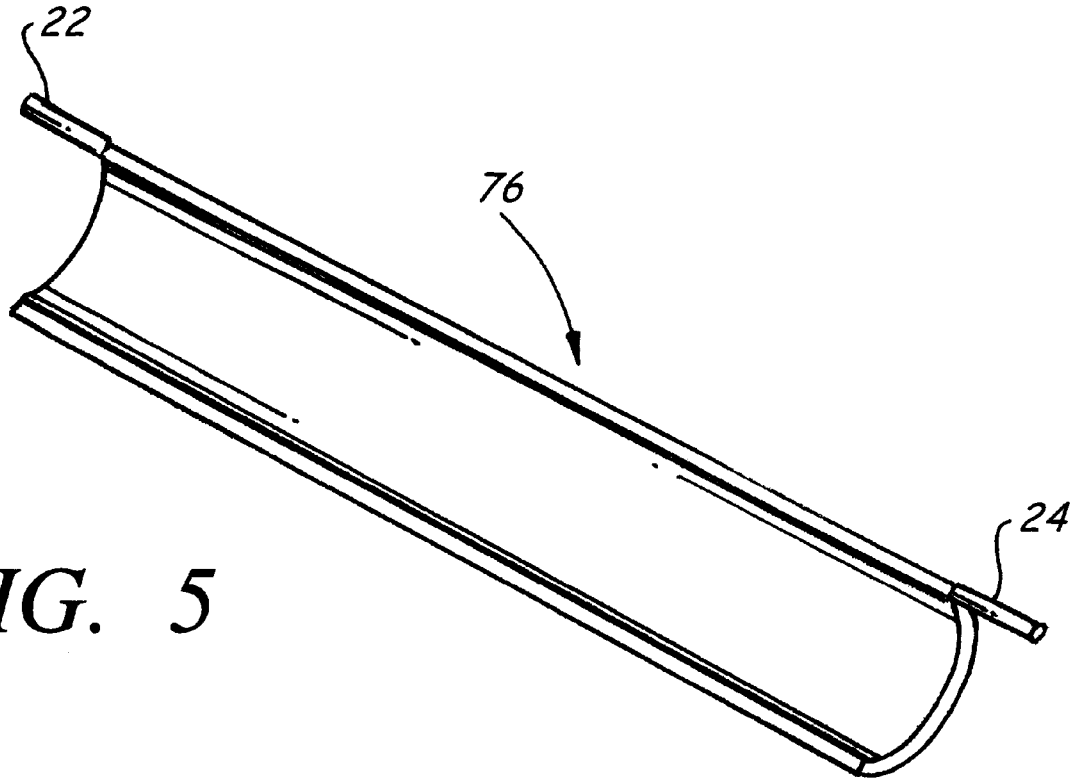

In FIGS. 2 and 4, truck 55 includes a bed including a pair of elongate, horizontally oriented, fixed beams 58 and 59. A pair of opposed, spaced apart, parallel rails 64, 65 are affixed to beams 59 and 58, respectively. A pair of opposed, spaced apart, parallel rails 56 and 57 rest on beams 58 and 59, respectively. Rails 56, 57, 64, 65 are each of equal shape and dimension. Parallel, spaced-apart linkage-arms 60 and 61 are each pivotally attached to rail 57 at their upper end and to beam 59 at their lower end. Parallel, spaced apart linkage-arms 90 and 91 are each pivotally attached to rail 56 at their upper end and to beam 58 at their lower end. Hydraulic piston assembly 63 is pivotally attached to beam 59 at its lower end and to rail 57 at its upper end. Hydraulic piston assembly 68 is pivotally attached to beam 58 at its lower end and to rail 56 at its upper end. As will be described, hydraulic piston assemblies 63 and 68 and linkage-arms 60, 61, 90, 91 are utilized to move rails 56 and 57 (and a container 10 setting on the rails 56, 57) between the transport position illustrated in FIG. 2 and the elevated load-unload position shown in FIG. 4.

Figure 3:
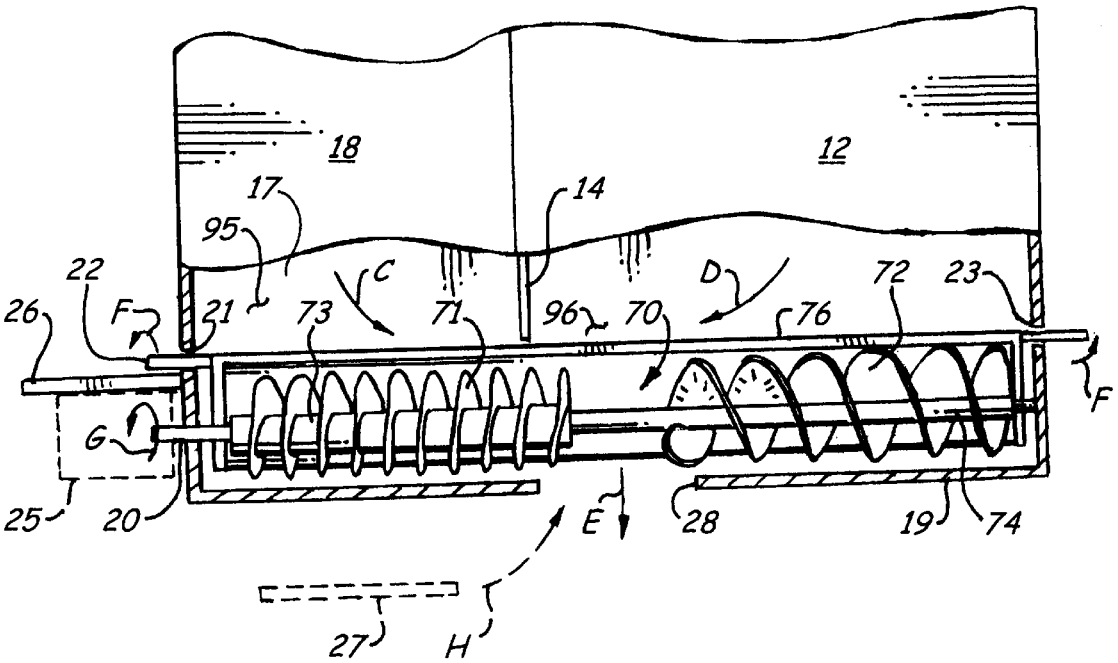
FIG. 3 is a partial section view of the apparatus of FIG. 1 illustrating the auger and valve utilized to dispense cementing material and mineral aggregate in a selected proportion with respect to one another.

As illustrated in FIG. 3, an auger 70 and metering valve 76 are mounted in the semi-cylindrical arcuate bottom 19 of the first and second storage chambers. One end of auger 70 is provided with spiral channel 71, the other end with spiral channel 72. Channel 71 is narrower than channel 72. Shaft 20 is fixedly attached to and outwardly extends from one end of auger 70. Shaft 20 can be manually rotated in the direction of arrow G to rotate auger 70 about its longitudinal axis. Or, a motor 25 can engage and turn shaft 20. Motor 25 is attached to plate 26. Plate 26 is fixedly secured to wall 16 and maintains the housing of motor 25 in a fixed position while motor 25 turns shaft 20 and auger 70 in the direction of arrow G or in any desired direction. Arcuate metering valve 76 has a radius greater than that of the blades forming channels 71 and 72 on auger 70. Rods 22 and 24 slidably extend through arcuate slots 21 and 23 formed in walls 16 and 13, respectively. Slots 21 and 23 have an identical shape and dimension. When rods 22 and 24 are at the ends of slots 21 and 23 nearest leg 41 (as shown in FIG. 1), then the openings 95 and 96 are fully "open" and the largest cross sectional area is available for cementing material and mineral aggregate to flow under gravity into channels 71 and 72 of auger 70. When rods 22 and 24 are slid through slots 21 and 23 in the direction of arrow F, the openings 95 and 96 are at least partially closed or constricted, reducing the flow of material into auger 70. Valve 76 can be shaped and dimensioned such that valve 76 can be operated to only partially close openings 95 and 96 or so that valve 76 can be operated to completely close openings 95 and 96. Rods 22 and 24 can be moved using a motor. The shape, dimension, operation, and construction of valve 76 can be altered as desired as long as valve 76 can be utilized to at least partially close openings 95 and 96.

When auger 70 is rotated, mineral aggregate 80 is displaced in the direction of arrow D toward opening 28 by channel 72 and cementing material 81 is displaced in the direction of arrow C toward arcuate--rectangular opening 28. When cementing material and mineral aggregate reach opening 28, they fall under gravity in the direction of arrow E into a wheelbarrow positioned beneath opening 28. If desired, opening 28 can be provided with a cover 27.

In operation, the leg members 46–49 of container 10 are extended to and secured in the position shown in FIG. 1. Pins 45 are inserted through aperture pairs 44–50 to secure each leg member 46–49 in the extended position shown in FIG. 1. The first storage chamber of container 10 is charged with sand and/or other mineral aggregate 80 such as gravel or broken rock. The sand is loaded through opening 15 into the first storage chamber. The second storage chamber of container 10 is charged with cement and/or another cementing material such as lime or gypsum plaster. The cement is loaded through opening 23 into the second storage chamber. The cementing material and mineral aggregate are normally dry. One advantage, however, of the container 10 of the invention is that wet sand or mineral aggregate can be utilized. In contrast, in prior art silos which dispense a premixed mortar blend, the sand used to manufacture the premixed blend must be dry, and, the premixed blend must be kept dry in the silo.

After container 10 is charged with cement 81 and sand 80, a truck 55 with rails 56, 57 in the position shown in FIG. 2 is backed up such that the truck moves in the direction of arrow P in FIG. 1 and the truck bed passes first between leg members 46 and 49 and then between leg members 47 and 48. The bed of the truck moves in the direction of arrow P and stops when (1) rail 57 is positioned directly beneath rollers 87 and 85, and (2) rail 56 is positioned directly beneath rollers 88 and 89 on container 10. Rollers 85, 87, 88 and 89 are spaced apart from rails 56 and 57. Hydraulic piston assemblies 63 and 68 are operated to extend assemblies 63 and 68 in the direction of arrow M. When assemblies 63, 68 extend in the direction of arrow M, linkage-arms 90, 91, 60, 61 pivot in the direction of arrow L and rails 56 and 57 are vertically displaced in the direction of arrow K. Assemblies 63 and 68 are operating until rails 56 and 57 contact rollers pairs 88–89 and 85–87, respectively, and lift the apparatus of FIG. 1 slightly off the ground. Pins 45 are removed from aperture pairs 44–50 and each leg member 46 to 49 is slid upwardly into its associated leg 40, 43, 42, 41 in the direction of arrow I to the stowed position and is secured in the stowed position by inserting a pin 45 through an aperture pair 44–50. In FIG. 4, all of the leg members are stowed with the exception of leg member 48. Once leg members 46–49 are stowed, hydraulic piston assemblies 63 and 68 are operated to retract the assemblies such that rails 56 and 57 (and container 10) descend and come to rest in the positions shown in FIG. 2 resting on beams 58 and 59, respectively. When rail 56 is resting on beam 58, rails 56 and 65 are co-linear and one end of rail 56 is closely adjacent one end of rail 65. When rail 57 is resting on beam 59, rails 57 and 64 are co-linear and one end of rail 57 is closely adjacent one end of rail 64. Tie downs or other means can be utilized to secure container 10 on rails 56 and 57 in the position shown in FIG. 2, or if there is no other container 10 on truck 55, container 10 can be rolled in the direction of arrow Q in FIG. 4 along rails 56 and 57 and onto rails 64 and 65 to the position occupied by container 10A in FIG. 2. In FIG. 2, container 10A is identical to container 10. Consequently, truck 55 is constructed to carry a pair of containers 10. When a container 10 setting on rails 64 and 65 is being unloaded, it is rolled in the direction of arrow J onto rails 56 and 57 to the position illustrated in FIG. 2.

Truck 55 is driven to a construction site remote from where the container 10 was charged and loaded on truck 55. At the remote site hydraulic assemblies 63 and 68 are extended to the position shown in FIG. 4. Pins 45 are removed from aperture pairs 44–50 and each stowed leg member 46–49 is extended in the direction of arrow N to the position shown in FIG. 1 and secured in the extended position by inserting pin 45 through an aperture pair 44–50. In FIG. 4, only leg member 48 has been extended. Legs 46–49 can be extended such that feet 50–53 contact or are slightly above the ground 80. After each leg member 46–49 has been slid downwardly from its stowed position in the direction of arrow N to an extended position and has been secured in the extended position, hydraulic assemblies 63 and 68 are operated and retracted to lower rails 56 and 57 in a direction opposite that of arrow K until they contact and rest on beams 58 and 59, respectively. Truck 55 is moved in a direction opposite that of arrow P in FIG. 1 to move the bed of the truck out from beneath container 10. Container 10 is left standing on the ground in the orientation illustrated in FIG. 1. A wheelbarrow or other desired receptacle is position on the ground beneath opening 28. Valve 76 is positioned as desired. Motor 25 or other means are operated to turn auger 70 such that a desired amount of cement and sand is displaced in the directions of arrows C and D and is dispensed under gravity through opening 28 into the wheelbarrow. Motor 25 rotates channels 71, 72 simultaneously at the same RPM, i.e. channels 71 and 72 are presently preferably mounted on a continuous, rigid shaft 74. A pair of augers, one having channel 71 and the other having channel 72, can be mounted separately and operated independently of one another.

Auger 70 can be constructed such that any desired proportion of sand to cement is dispensed through opening 28. Multiple augers 70 can be provided. One auger can, for example, dispense three parts of sand for each part of cement dispensed through opening 28. Another auger can dispense two parts of sand for each part of cement dispensed through opening 28.

Shaft 20 can extend through wall 13 instead of wall 16, and motor 25 can be mounted on shaft 20 adjacent wall 13.

Having described my invention in such terms as to enable those skilled in the art to understand and practice it, and having identified the presently preferred embodiments thereof, I claim:

1. A system for transporting cementing material and mineral aggregate from a first site to a remote second site and for dispensing said cementing material and mineral aggregate at said second site, including (a) a container having a first compartment for cementing material and a second compartment for mineral aggregate, each of said compartments having a top and a bottom;

(b) means attached to the bottom of said first and second compartments to receive and dispense cementing material from said first compartment and mineral aggregate from said second compartment;

(c) a plurality of legs connected to said container and each adjustable between a first length and a second length longer than said first length;

(d) a vehicle having a bed (i) shaped to fit beneath said container when said legs are adjusted to said second length, and (ii) means mounted on said bed to receive and support said container and displaceable between a first raised operative position to support said container to permit each of said legs to be adjusted from said second length to said first length, and a second operative position in which said bed and said container are lowered into a transport position on said vehicle.

* * * * *